US005510588A

United States Patent [19]

Suzuki et al.

[11] Patent Number: 5,510,588

[45] Date of Patent: Apr. 23, 1996

[54] IMAGE INTENSIFIER APPARATUS

[75] Inventors: Hideki Suzuki; Shoichi Uchiyama, both of Hamamatsu, Japan

[73] Assignee: Hamamatsu Photonics K.K., Hamamatsu, Japan

[21] Appl. No.: 222,308

[22] Filed: Apr. 4, 1994

[30] Foreign Application Priority Data

Apr. 6, 1993 [JP] Japan ..... 5-079601

[51] Int. Cl.[6] ..... H01J 40/14

[52] U.S. Cl. ..... 250/207; 250/214 VT; 313/524

[58] Field of Search ..... 250/207, 214 VT; 313/524, 103 R, 103 CM, 105 CM

[56] References Cited

U.S. PATENT DOCUMENTS

| | | | |
|---|---|---|---|
| 3,665,196 | 5/1972 | Macall | 250/83.3 H |
| 3,787,668 | 1/1974 | Currie et al. | 235/152 |
| 3,788,831 | 1/1974 | Orthuber . | |
| 3,970,875 | 7/1976 | Leehan | 307/304 |
| 3,975,648 | 8/1976 | Tobey, Jr. et al. | 307/297 |
| 4,004,148 | 1/1977 | Howard et al. | 250/370 |
| 4,007,415 | 2/1977 | Toyoda | 323/19 |
| 4,045,675 | 8/1977 | Kingsley et al. | 250/370 |
| 4,054,797 | 10/1977 | Milton et al. | 250/332 |
| 4,064,448 | 12/1977 | Eatock | 323/22 T |
| 4,095,136 | 6/1978 | Niklas | 250/214 VT |
| 4,115,692 | 9/1978 | Balcerak et al. | 250/338 |
| 4,189,522 | 8/1978 | Thompson | 73/154 |
| 4,555,731 | 11/1985 | Zinchuk | 250/214 VT |
| 4,978,195 | 12/1990 | Takano et al. | 250/214 VT |
| 5,025,144 | 6/1991 | Odom et al. | 250/207 |
| 5,115,667 | 5/1992 | Baret . | |
| 5,285,061 | 2/1994 | She et al. | 250/214 VT |
| 5,408,088 | 4/1995 | Chapman et al. | 313/524 |

FOREIGN PATENT DOCUMENTS

| | | |
|---|---|---|
| 0402827 | 12/1990 | European Pat. Off. . |
| 63-29781 | 6/1988 | Japan . |
| 2-33840 | 2/1990 | Japan . |

OTHER PUBLICATIONS

Needham, "Microchannel Plates Advance Night–Viewing Technology", Electronics, vol. 46, No. 20, Sep. 27, 1973, pp. 117–124.

Patent Abstracts of Japan, vol. 14, No. 182 (E–0916) 12 Apr. 1990, & JP–A–02 033 840 (Hamamatsu) Feb. 5, 1990, * abstract *.

Infrared Detectors, Halsted Press Series—Pass IC Regulators Still the Perennial Favorite, "Electronics", 1977.

*Primary Examiner*—Stephone B. Allen

*Attorney, Agent, or Firm*—Cushman Darby & Cushman

[57] ABSTRACT

An image intensifier apparatus of this invention comprises a photocathode for converting a first optical image to corresponding photoelectrons, a microchannel plate for multiplying the photoelectrons, impressed with a voltage at both ends thereof, and a fluorescent screen for converting the photoelectrons multiplied in the microchannel plate to a second optical image, emitting the second optical image to an image pickup device. Resistance of the microchannel plate is greater than or equal to $2.8\times10^{15}$ GΩ and less than or equal to $2.8\times10^{16}$ GΩ per channel. Therefore, in a case that a luminance of the second optical image is smaller than or equal to saturation sensitivity of the image pickup device, the luminance of the second optical image is proportional to an illuminance of the first optical image, and in a case that the luminance of the second optical image is larger than saturation sensitivity of the image pickup device, the luminance of the second optical image is suppressed against increment of the illuminance of the first optical image. Thus, the halo phenomenon effect having a relatively large luminance is decreased.

8 Claims, 8 Drawing Sheets

IMAGE INTENSIFIER APPARATUS

BACKGROUND OF THE INVENTION

1. Field of the Invention

This invention relates to an image intensifier apparatus.

2. Related Background Art

An image intensifier apparatus is an apparatus for intensifying an extremely weak optical image few ten thousands times to enable that the optical image can be visible, and which is used for a two-dimensional measurement of extremely weak light, such as a noctovision. It is assumed that this apparatus is used under the extremely weak light. Under stronger light, halo phenomenon becomes a subject of a discussion.

FIG. 1 shows this phenomenon. The halo phenomenon is a phenomenon that a limited circular area 220 of light around a spotlight appears on a fluorescent screen as a result of the bright spotlight 210 entering the photocathode of the image intensifier. The explanation of this phenomenon is described in the paper "MIL-I-49052D 3.6.9, 4.6.9, 6.3.8". FIG. 2 shows a luminous distribution in this case. In FIG. 2, the halo of 1.00 mmØ appears around the spotlight of approximately 0.15 mmØ. In a case that the halo is weak, all are relatively weak, so that no problems are arose; however, in a case that the halo is strong, some places, where no light incides, conspicuously brighten, so that picture quality is substantially lowered. This is a unique characteristic of the image intensifier, which has been requested to be improved.

As a countermeasure for the halo phenomenon, an electric method by the applicant of this invention is disclosed in Japanese Patent Publication No. 63-29781 (29781/1988) and other electric methods have been introduced. The method described in this publication is to control voltages impressed to a microchannel plate or others by detecting current of electrons toward the fluorescent screen so that this current does not exceed a certain value, and to suppress generation of surplus electrons by this control. Therefore, the halo phenomenon effect can be suppressed.

The halo phenomenon is explicated by the applicant of this invention, and the explanation is disclosed in "Japanese Patent Publication No. 33840/1990". FIG. 3 shows a mechanism of the halo, and the mechanism will be explained below. Photoelectron of the spotlight photoelectrically converted in a photocathode is accelerated and multiplied in a microchannel plate (MCP) 130. The multiplied electrons are accelerated in the acceleration electric field and strike a fluorescent screen 116, and then emit fluorescence. At this time, the electrons scatter on an aluminum metal backing evaporated on the fluorescent screen 116. Partial electrons go to the MCP 130, but they are pushed back in the acceleration electric field and reenter to the fluorescent screen 116, and then emit fluorescence. The quantity of reflected electrons on the fluorescent screen 116 is two digits lower than that of the incident electrons. However, in the case of the bright spotlight, the reflected electrons relatively increase, and then cause the halo phenomenon, so that some places, where the spotlight or other lights do not incide, brighten with the electrons scattered on the fluorescent screen 116.

In the above publication "Japanese Patent Publication No. 33840/1990", it is introduced that in order to avoid the halo phenomenon, light element such as carbon is evaporated on the aluminum metal backing evaporated on the fluorescent screen 116, so that the reflected electrons can be suppressed, and this is applied to a streak tube. The inventors of the present invention recognized that the reflected electrons can be suppressed if this method is applied to the image intensifier apparatus; however, the inventors were not satisfied with its characteristics. Thus, in order to decrease the halo phenomenon effect of the image intensifier apparatus, the inventors come to this invention.

SUMMARY OF THE INVENTION

In order to solve the above-described problems, an image intensifier apparatus of this invention comprises a photocathode for converting a first optical image to corresponding photoelectrons, a microchannel plate for multiplying the photoelectrons, impressed with a voltage to both ends of the microchannel plate, and a fluorescent screen for converting the photoelectrons multiplied in the microchannel plate to a second optical image, emitting the second optical image to an image pickup device. A resistance of the microchannel plate is set so that in a case of a luminance of the second optical image being smaller than or equal to saturation sensitivity of the image pickup device, the luminance of the second optical image is proportional to an illuminance of the first optical image, and in a case of the luminance of the second optical image being larger than saturation sensitivity of the image pickup device, the luminance of the second optical image is suppressed against increment of the illuminance of the first optical image.

Here, it is preferable that the microchannel plate is a collection of a plurality of channels, and the resistance per channel is greater than or equal to $2.8\times 10^{15}$ Ω and less than a equal to $2.8\times10^{16}$ Ω.

Further, it is preferable that the microchannel plate has an effective diameter of 18 mm, and the strip resistance is greater than or equal to 1 GΩ and less than or equal to 10 GΩ.

Further, an image pickup apparatus comprises a photocathode for converting a first optical image to corresponding photoelectrons, a microchannel plate for multiplying the photoelectrons, impressed with a voltage at both ends of the microchannel plate, a fluorescent screen for converting the photoelectrons multiplied in the microchannel plate to a second optical image, and an image pickup device for receiving the second optical image, converting the second optical image to charge signal. A resistance of the microchannel plate is set so that in a case of a luminance of the second optical image being smaller than or equal to saturation sensitivity of the image pickup device, the luminance of the second optical image is proportional to an illuminance of the first optical image, and in a case of the luminance of the second optical image being larger than saturation sensitivity of the image pickup device, the luminance of the second optical image is suppressed against increment of the illuminance of the first optical image.

Here, it is preferable that the microchannel plate is a collection of a plurality of channels, and the resistance per channel is greater than or equal to $2.8\times 10^{15}$ Ω and less than or equal to $2.8\times10^{16}$ Ω.

Further, it is preferable that the microchannel plate has an effective diameter of 18 mm, and the strip resistance is greater than or equal to 1 GΩ and less than or equal to 10 GΩ.

Further, it is preferable that the image pickup device is a charge coupled device.

Moreover, it is preferable that the image pickup device is coupled on a side of an output of the fluorescent screen using an optical fiber.

According to such an image intensifier apparatus and an image pickup apparatus, the resistance of the microchannel plate per channel or the strip resistance is set to the above-described value. Accordingly, in the case that illuminance of the optical image entered to the photocathode is extremely weak and luminance of the optical image emitted from the fluorescent screen is smaller than or equal to saturation sensitivity of the image pickup device, the photoelectrons are multiplied by a certain multiplication factor in the microchannel plate corresponding to the quantity of incident light in the photocathode. Therefore, the output luminance in the fluorescent screen is proportional to the incident light in the photocathode.

On the other hand, in the case that illuminance of the optical image entered to the photocathode is larger, and luminance of the optical image emitted from the fluorescent screen is larger than saturation sensitivity of the image pickup device, an automatic gain control (AGC) works on photoelectron multiplication effect to the quantity of the incident light in the photocathode, and the multiplication factor decreases, so that the generation of surplus electrons is limited. Accordingly, the image intensifier apparatus or the image pickup apparatus has a saturation characteristic that the output luminance in the fluorescent screen is suppressed against increment of the quantity of incident light in the photocathode, and finally, the output luminance does not exceed the maximum value. Therefore, appearance of the halo phenomenon having relatively large luminance is decreased.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DETAILED DESCRIPTION OF THE PREFERRED EMBODIMENTS

Figure 1:
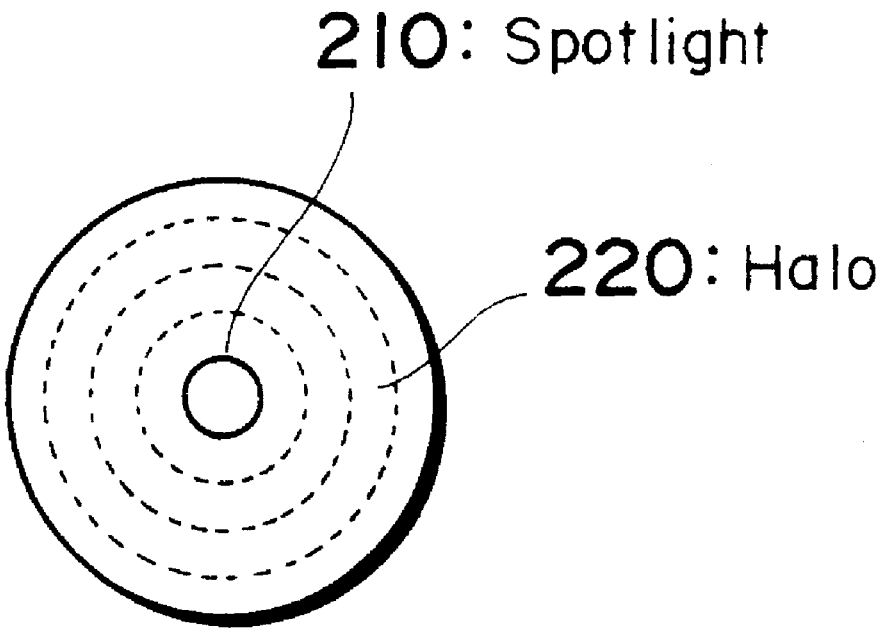
FIG. 1 shows a halo.
Figure 2:
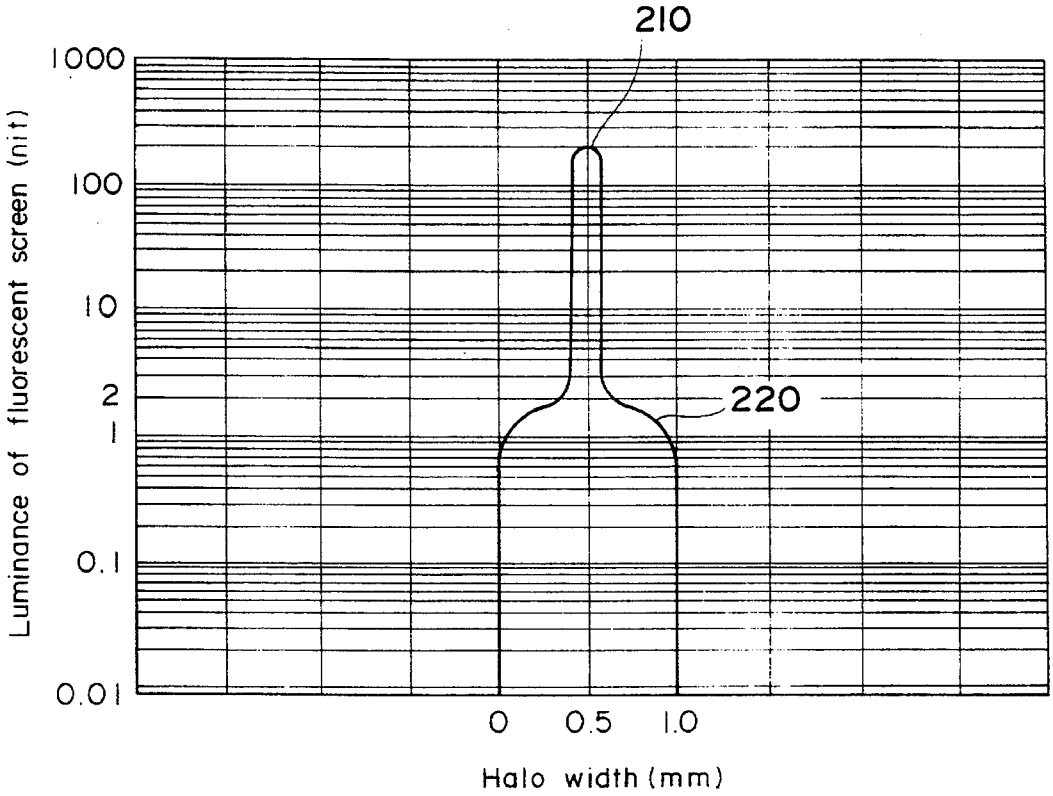
FIG. 2 shows a luminance distribution for a spotlight.
Figure 3:
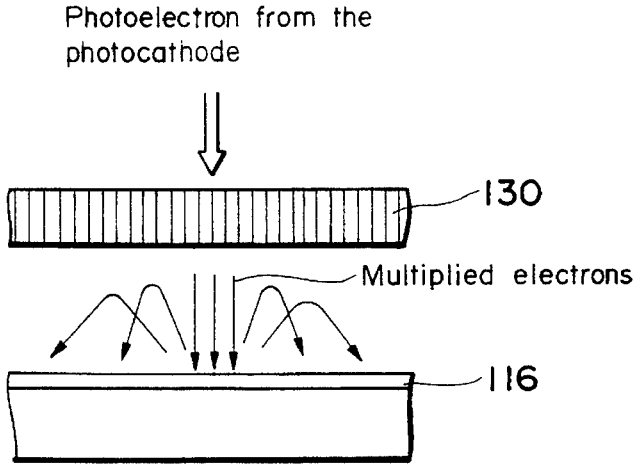
FIG. 3 shows a mechanism of a halo.
Figure 4:
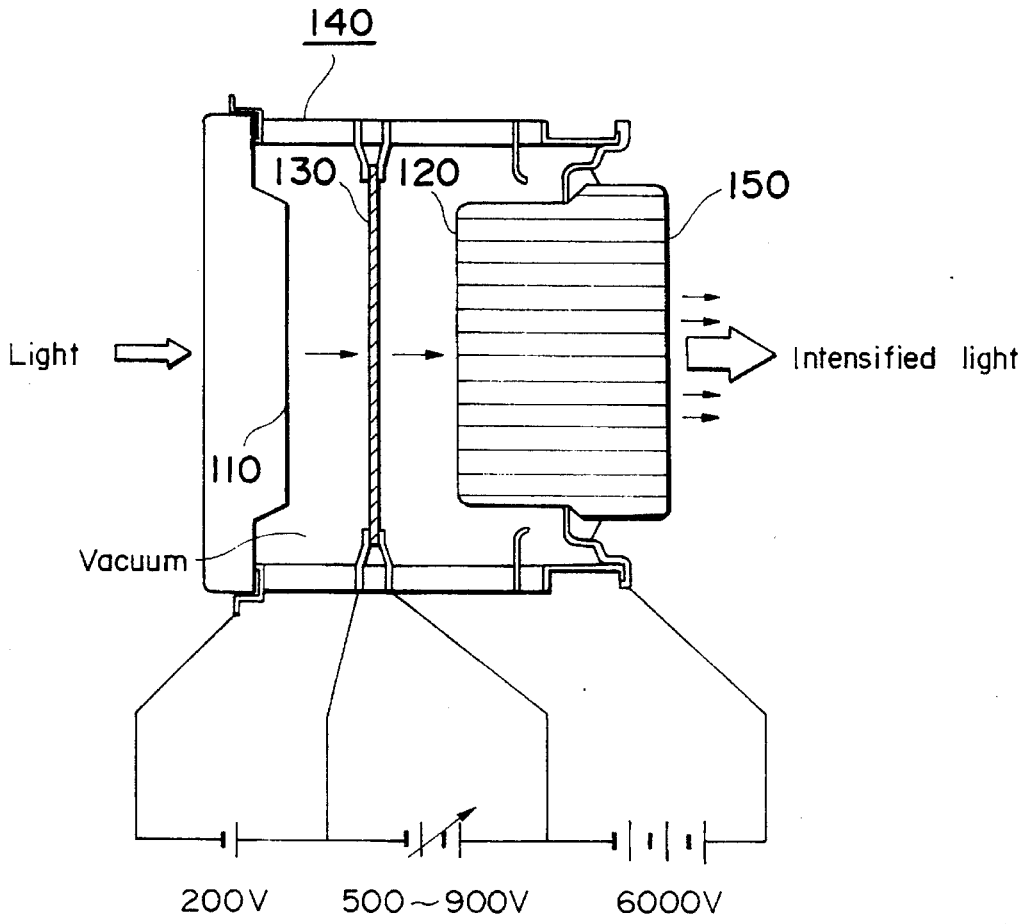
FIG. 4 shows a structure of an image intensifier apparatus.

The embodiment of an image intensifier apparatus according to this invention will be explained with reference to the drawings attached hereto. FIG. 4 shows a structure of the image intensifier according to this embodiment. The apparatus is what is called a proximity image intensifier apparatus comprising a photocathode 110, an MCP 130, a fluorescent screen 120 and others in a vacuum tube 140, which is the same structure as the conventional apparatus; however, the MCP 130 of this invention has a resistance greater than or equal to $2.8\times 10^{15}$ Ω and less than or equal to $2.8\times10^{16}$ Ω per channel. First, the parts of this apparatus will be explained.

The photocathode 110 is placed at an inner surface on the side of the input of the tube 140, and converts an incident light to a number of photoelectrons corresponding to brightness of the incident light. The MCP 130 is a collection of a plurality of channels (approximately 10 μmϕ per channel) for intensifying photoelectrons, and has a multiplication factor approximately $10^4$. Its effective diameter is 18 mm, and its strip resistance is greater than or equal to 1 GΩ and less than or equal to 10 GΩ since the resistance per channel is the value as described above. Owing to this resistance, in a case that the incident light has a small intensity, the multiplication factor is constant, whereas in a case that the incident light has a large intensity, the multiplication factor is decreased so that the increment of photoelectron is suppressed.

Here, the resistance of the MCP 130 will be set below. The MCP 130 is placed inside of a vacuum furnace after molding with a lead glass, and it is deoxidized from the surface to the inside by an inflow of hydrogen gas under high temperature. Then, as a low resistance layer is grown by precipitating a lead metal on the side of the surface, the MCP 130 gradually varies from an insulating state to a conducting state. Therefore, the resistance of the MCP 130 is set to a desired value by controlling the growth of the low resistance layer with parameters, such as an atmosphere temperature, a hydrogen gas concentration, a deoxidation time and so on.

Figure 5:
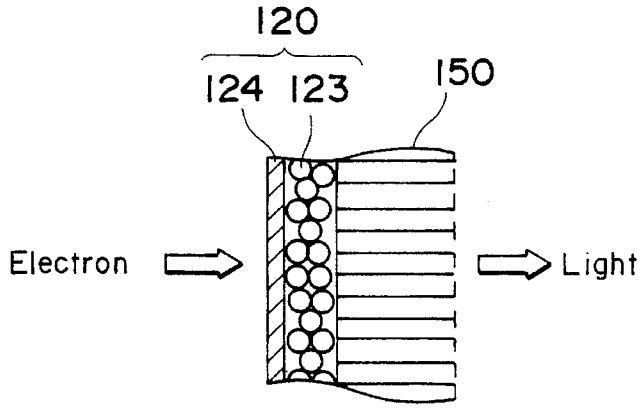
FIG. 5 shows a magnified diagram of a photocathode and periphery.

The fluorescent screen 120 emits fluorescence by bombardment of electrons multiplied by the MCP 130, and comprises an aluminum metal backing 124 deposited on a fluorescent substance 123 coated as shown in FIG. 5. Further, the fluorescent screen 120 is fiber-coupled with optical fibers 150 for connecting with a CCD or others. High voltages are impressed to the photocathode 110, the MCP 130, and the fluorescent screen 120 from the outside, and parallel electric fields between each two of the photocathode 110, the MCP 130, and the fluorescent screen 120 prevent electrons from spreading. Here, 200 V to between the photocathode 110 and the MCP 130, 500 V to 900 V to the MCP 130, and 6 kV to between the MCP 130 and the fluorescent screen 120 are impressed, and the voltage of the MCP 130 is variable.

Figure 6:
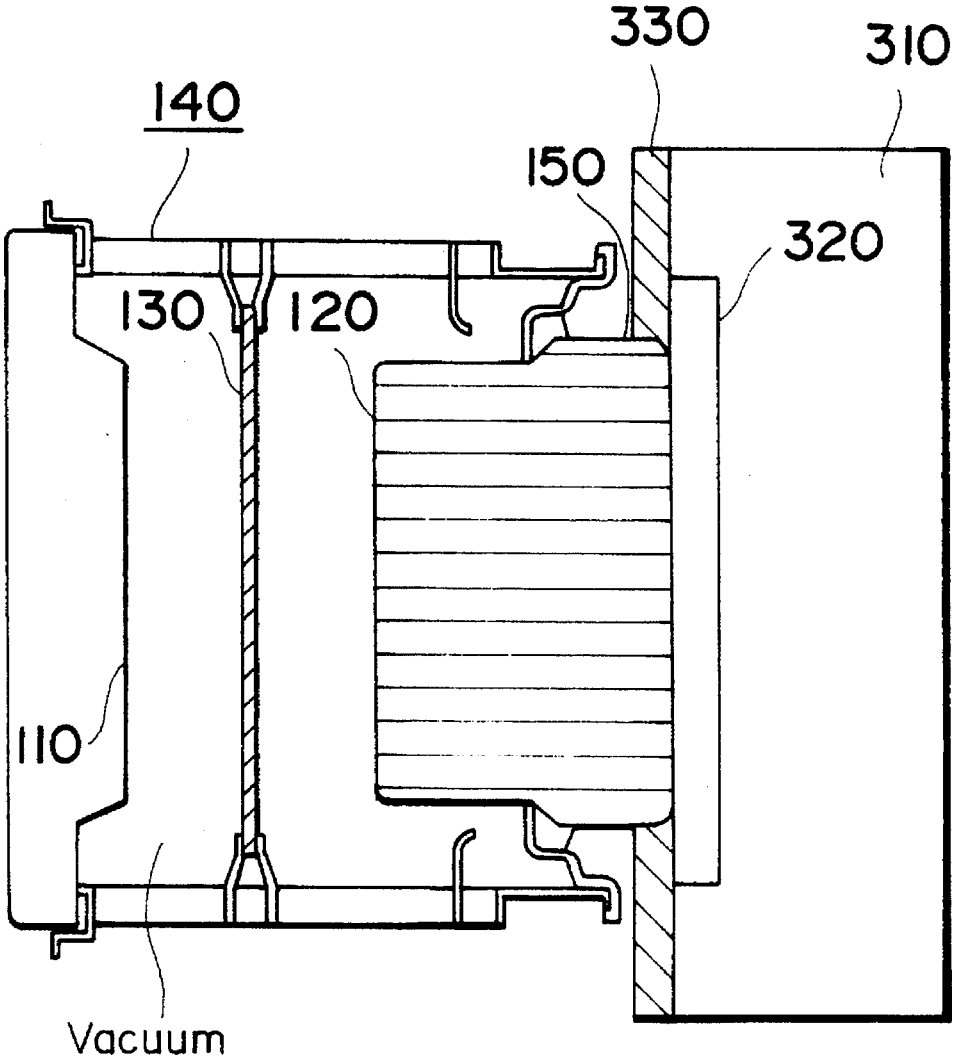
FIG. 6 shows a structure that an image pickup device is placed to an image intensifier.

In general use, as shown in FIG. 6, an image pickup device is placed on the side of output plane of the fluorescent screen 120. As the image pickup device, for example, a CCD 320 and a metal layer 330 are formed on the side of a surface of a silicon base substrate 320. The CCD 320 comprises a plurality of photosensitive pixels for receiving an optical pattern signal deposited in two-dimension, and a signal read unit for reading signal charges accumulated in the photosensitive pixels in order. Further, the metal layer 330 outputs the charged signal detected in the CCD 320 to the outside.

In the image pickup device, the CCD 320 is coupled with the fluorescent screen 120 through the optical fibers 150, and receives fluorescence emitted from the fluorescent screen 120. Further, resistance of the MCP 130 is set to the value corresponding to the saturation sensitivity of the CCD 320.

In such an image intensifier apparatus, when the optical image is formed on the photocathode 110 through a lens, a number of photoelectrons corresponding to brightness of the image emit from the photocathode 110. The electronic image with photoelectrons is nearby converged in electric field between the photocathode 110 and the MCP 130, and is formed on the incident plane of the MCP 130. In the MCP 130, the electrons are multiplied few thousands times while passing through there, and are nearby converged and accelerated in electric field between the MCP 130 and the fluorescent screen 120. Then, the electrons bombard to the fluorescent screen 120, and become an optical image again. The optical image is, in result, the incident light multiplied few ten thousands times, and received at the CCD 320.

The image intensifier apparatus is generally used under the quantity of light below 0.1 lx; however, there are some bright light sources such as a headlight, a street lamp and so on, in field at night, compared to the dark field. When the bright light enters to the image intensifier apparatus, the strong spot is formed on the fluorescent screen owing to the multiplier effect, and the corresponding halo phenomenon appears. The halo is a false image, so that it is harmful as an image information. However, in this invention, the halo is decreased by controlling output current from the MCP, which is a source of the halo appearance, using a high resistance MCP.

Figure 7:
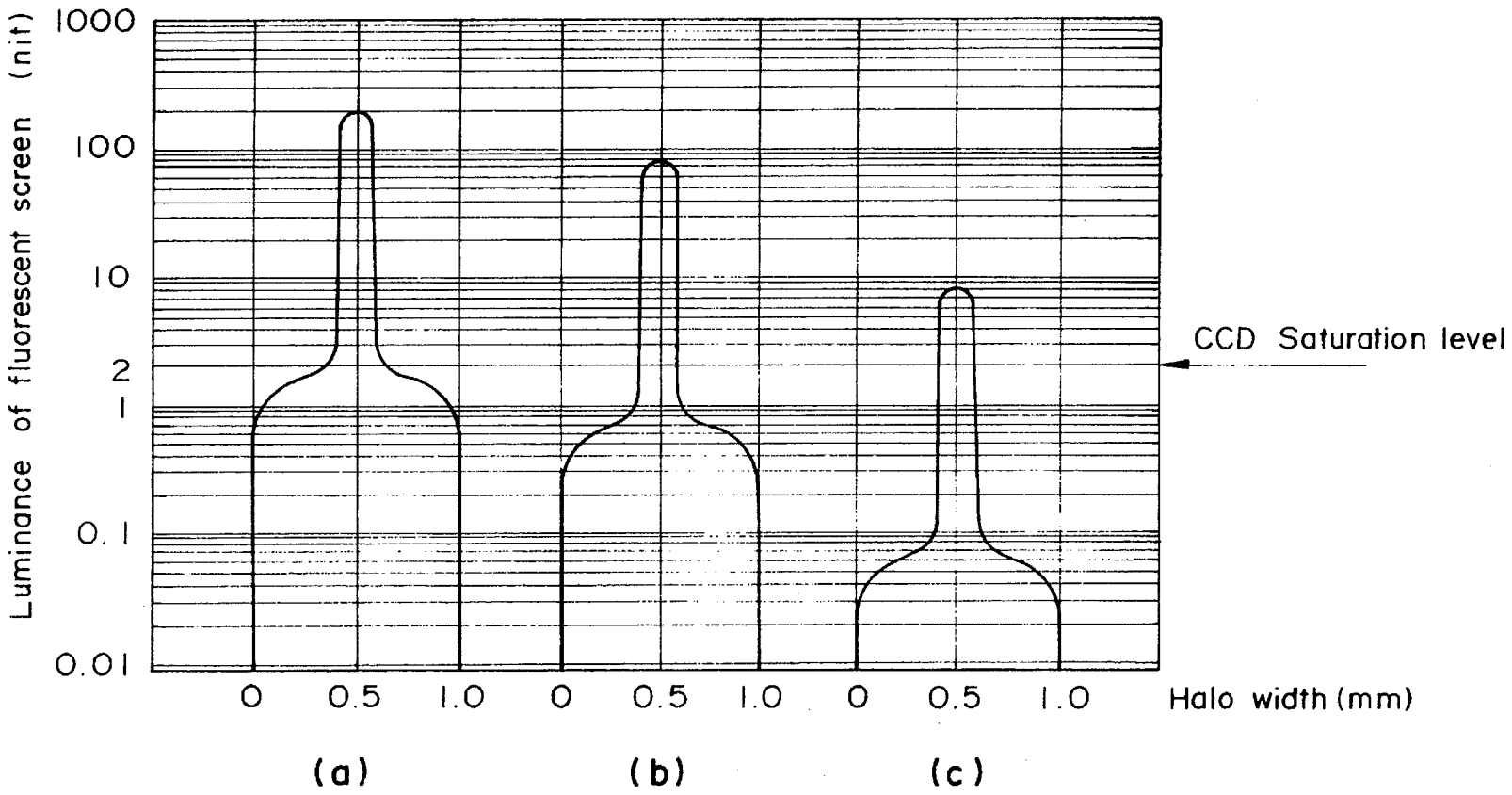
FIG. 7 shows a difference of luminance distributions for a spotlight when a strip resistance varies.

FIG. 7 shows the halo appearance and luminance variation of the spot on the fluorescent screen when the same spotlight enters to the photocathode 110. Measurement was done under the condition that the size of the spotlight to the photocathode 110 is 0.15 mm, the luminance of the spotlight is 1 lx, the luminous gain is $1 \times 10^3$ fl/fc, the effective diameter of the MCP is 18 mmϕ, and the strip resistance 200 MΩ ($5.6\times10^{14}$ Ω per channel), 1 GΩ ($2.8\times10^{15}$ Ω per channel), and 10 GΩ ($2.8 \times10^{16}$ Ω) were used. FIG. 7 shows a luminance of the fluorescent screen on the vertical axis, and a halo width due to resistance difference per channel of the MCP on the horizontal axis.

Figure 8:
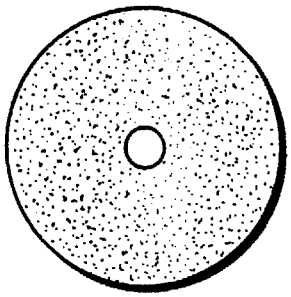
FIG. 8, FIG. 9, and FIG. 10 show a variation of a halo on a fluorescent screen.
Figure 9:
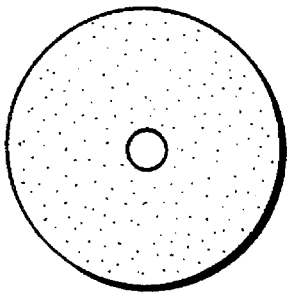
Figure 10:
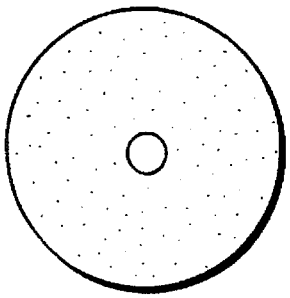
Figure 11:
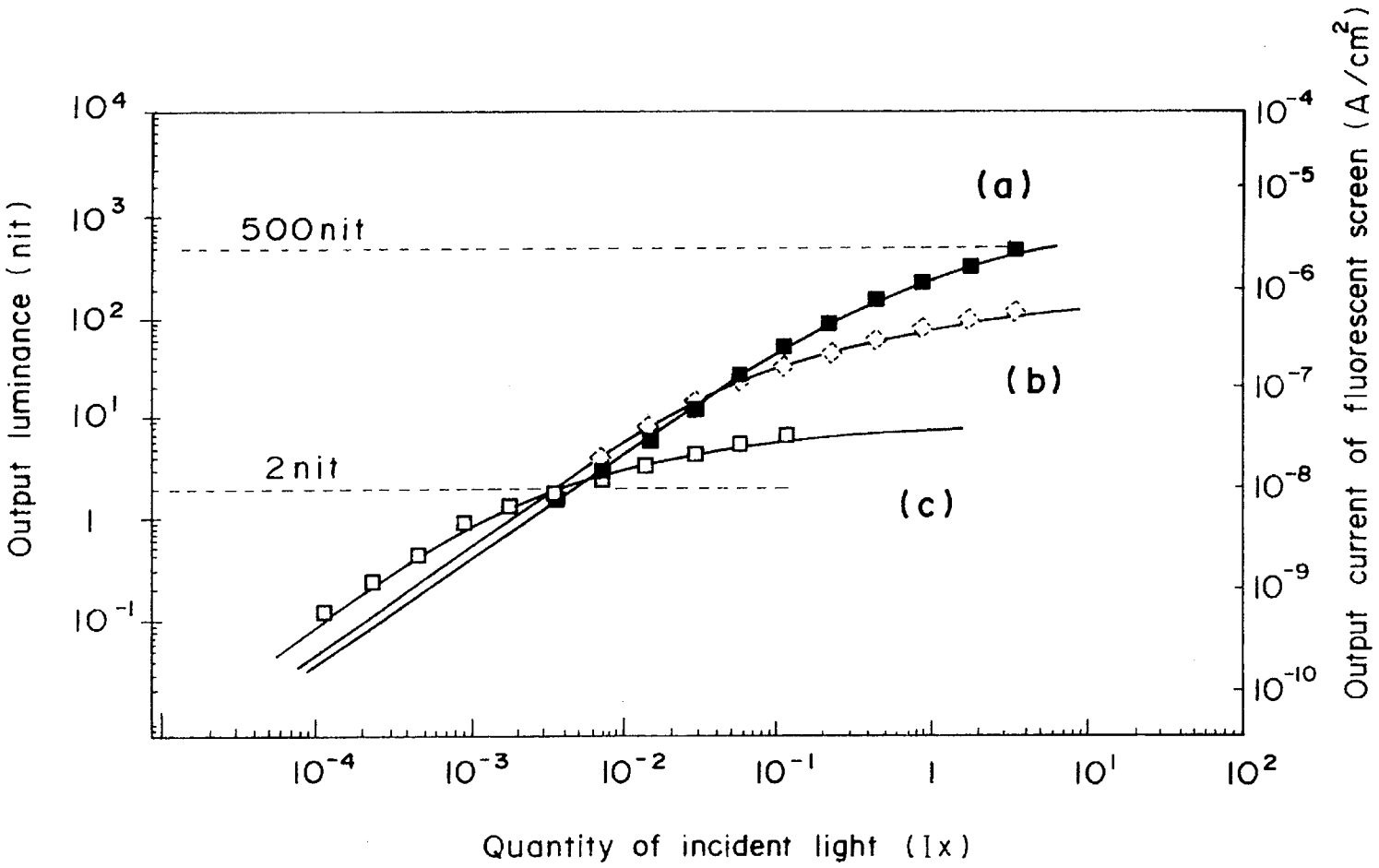
FIG. 11 shows a characteristics of an output luminance on a fluorescent screen and an output current from the MCP to a fluorescent screen.

FIG. 7 (*a*) is a case of 200 MΩ, which is corresponded to the conventional one. Further, FIG. 7 (*b*) is a case of 1 GΩ, and FIG. 7 (*c*) is a case of 10 MΩ, and FIG. 7 (*b*) and FIG. 7 (*c*) are cases of using higher strip resistance than the conventional one. In graph, peaks (200 nit, 80 nit, and 8 nit) indicate the area of the spotlight, and bottoms indicate the halo. FIG. 8, FIG. 9, and FIG. 10 are cases of using the above-described resistance values, and show conditions of the fluorescent screen corresponding to the resistance values. Further, FIG. 11 shows a relation between a luminance of the spotlight (output luminance) on the fluorescent screen and output current from the MCP to the fluorescent screen corresponding to the quantity of incident spotlight in the cases of FIG. 7. FIG. 11 (*a*) is in a case of the strip resistance 200 MΩ of the MCP, FIG. 11 (*b*) is in a case of 1 GΩ, and FIG. 11 (*c*) is in a case of 10 GΩ.

In the case that the spotlight of 0.15 mmϕ enters to the photocathode, the approximately 1 mmϕ halo appears around the spotlight on the fluorescent screen, and the luminance of the halo is two digits lower than the center (center of the spotlight) (this is the same even if the luminance of the spotlight on the fluorescent screen is varied). However, in the case that the strip resistance is 200 MΩ, using the MCP having a general strip resistance, when the spotlight having a large luminance enters to the photocathode, the fluorescent screen brightens up to hundreds nit, and at this time, the output current increases to few μA/cm$^2$. In such a case, for example, when the spotlight of a car enters, the image of car itself or peripheral images are crashed due to the halo because the car arid periphery are darker than the spotlight. In result, picture quality becomes poor.

On the other hand, in the cases of FIG. 7 (*b*) and FIG. 7 (*c*) as described above, using the MCP having a larger strip resistance than the general one, even though the spotlight having a large luminance enters to the photocathode, the output luminance on the fluorescent screen is suppressed, and the halo is also suppressed to low level. Therefore, the halo relatively decreases, so that the peripheral images, which are darker than the spotlight, is hardly crashed. Thus, the picture quality is maintained high.

In a case that the image intensifier apparatus and the CCD are directly fiber-coupled, in general, approximately 2 nit luminance of the fluorescent screen is the saturation level of the CCD (at this time, output current to the fluorescent screen is approximately 10 nA/cm$^2$). Therefore, in the case of using the CCD, according to the relation in FIG. 11, it is to be desired that the luminance of the fluorescent screen is linear at less than or equal to 2 nit, and it is saturated at greater than or equal to 2 nit. In such a case, a CCD operational level is less than 2 nit, and an incident light versus output luminance characteristic is linear in the region below 2 nit in FIG. 11, so that linearity of the detective level of the CCD corresponding to the incident light maintains the same, and in this region, measurement with high linearity using the CCD can be possible. Further, in the region above 2 nit, the CCD operation is saturated, but in the case of FIG. 7 (*a*) as described above, as output luminance increases, the halo luminance also increases, so that the images around the spotlight are crashed. On the other hand, in the cases of FIG. 7 (*b*) and FIG. 7 (*c*) as described above, the output luminance is saturated, whereas the halo luminance is suppressed. Therefore, the halo relatively decreases compared to the case of FIG. 7 (*a*) as described above, and images around the spotlight are saved from crashing.

The strip resistance is desired to be greater than or equal to 1 GΩ since the output luminance is saturated at lower level of the incident spotlight as the strip resistance increases. However, when the strip resistance is greater than or equal to 10 GΩ, the linearity of an incident light versus output luminance characteristic is worse in the region below 2 nit. Then, problems such as contrast deterioration appear. Therefore, it is a experimentally proper value that the strip resistance is greater than or equal to 1 GΩ and less than or equal to 10 GΩ (that is, the resistance per channel is greater than or equal to $2.8\times10^{15}$ GΩ and less than or equal to $2.8\times 10^{16}$ GΩ), and this range of resistance has practically no 10 problems. Taking this range, in the usual case of using a CCD, such as an ICCD camera, which the image intensifier apparatus and the CCD are directly fiber-coupled, the excellent measurement (for example, a noctovision or two-dimensional measurement of weak light) can be possible. The suitable MCP resistance depends on the luminance used.

Thus, using the MCP having the strip resistance greater than or equal to 1 GΩ and less than or equal to 10 GΩ (that is, the resistance per channel is greater than or equal to $2.8\times10^{15}$ GΩ and less than or equal to $2.8\times 10^{16}$ GΩ), even if the bright spotlight enters to the image intensifier apparatus, output current of the MCP is limited owing to saturation characteristic of the MCP. Therefore, electrons entering to the fluorescent screen decrease, and reflected electrons from the fluorescent screen also decrease. Decrement of electrons and decrement of reflected electrons are larger than when the conventional MCP (strip resistance is from 100 MΩ up to 300 MΩ) is used.

Figure 12:
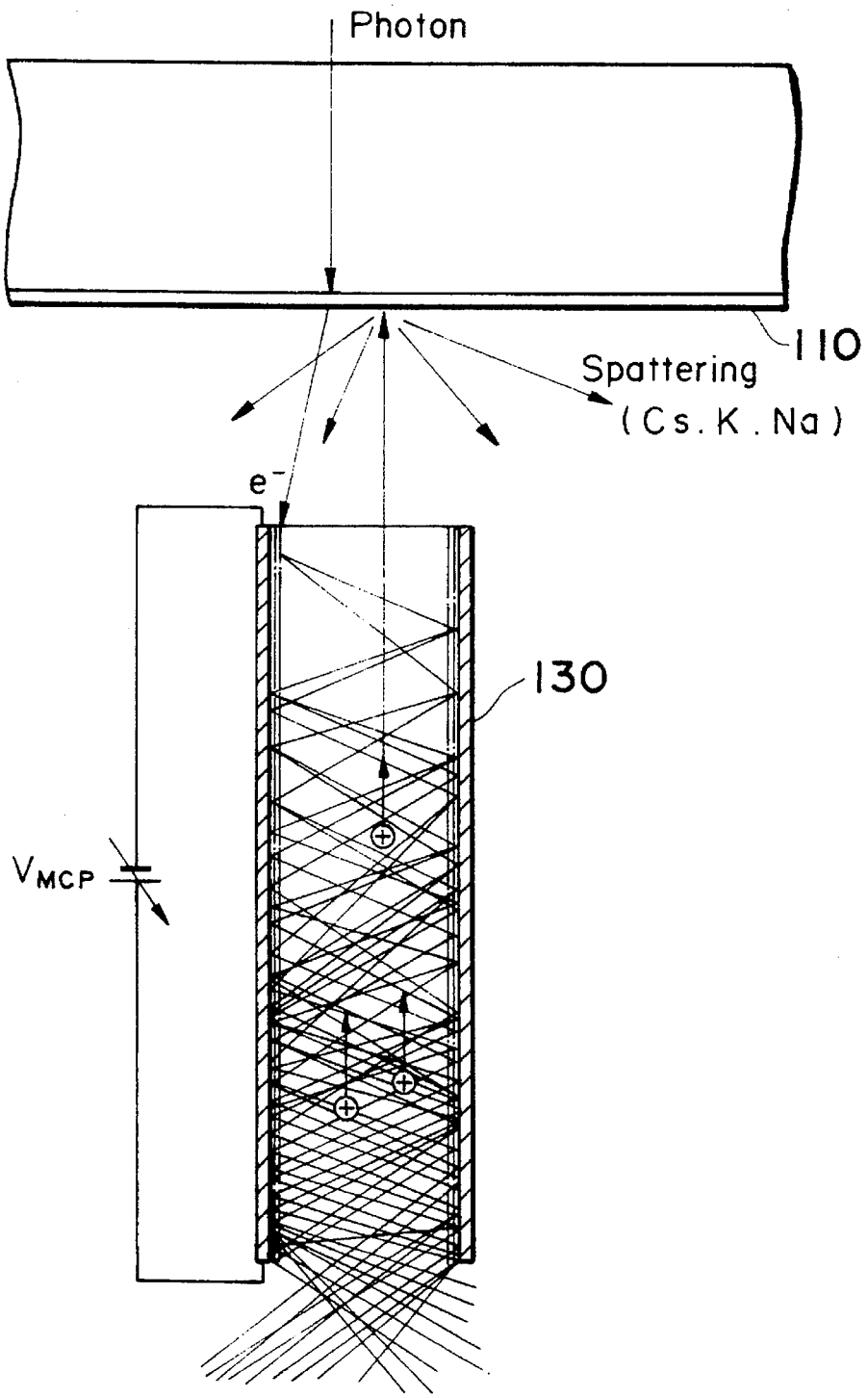
FIG. 12 shows a mechanism of an ion feedback.

Further, as the resistance of the MCP is set to the above value, the density of electrons generated nearby the output of the MCP decrease is, so that ion feedback to the photocathode decreases, and the deterioration (burning) of the photocathode hardly appears. FIG. 12 shows a mechanism of the ion feedback and in a case that photoelectrons generated in the photocathode 110 by a photon are multiplied and electron density nearby the output of the MCP 130 increases. Residual gas exists in the tube 140 and bombards with electrons and then is ionized. The generated ions are accelerated in electric field impressed to the MCP 130 and electric field impressed between the photocathode 110 and the MCP 130, and strike to the photocathode 110, and then spattering of alkali metal (Cs, K, Na, etc.) appears. Probability of being ionized becomes larger as the electron density is higher. Especially nearby the output of the MCP 130, the electron density is high.

In the case of FIG. 7 (*a*) as described above, as the incident light is larger, the electron density nearby the output of the MCP 130 becomes extremely larger, and the deterioration of the photocathode easily appears. On the other hand, in the cases of FIG. 7 (*b*) and FIG. 7 (*c*) as described above, the electron density is saturated, and the residual gas being ionized is suppressed, so that the deterioration of the photocathode hardly appears.

This invention is not limited to the embodiment as described above, and it can be varied in many ways.

For example, the proximity type image tube is shown in FIG. 4 but the inverter type may be used.

Thus, according to the image intensifier apparatus of this invention, for an optical image with high illuminance, generation of surplus electrons in the microchannel plate is suppressed, and the halo effect is relatively suppressed, so that the image intensifier apparatus with high performance, in which no deterioration of picture quality or deterioration of the photocathode appears, can be provided.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An image intensifier apparatus comprising:

a photocathode for converting a first optical image to corresponding photoelectrons;

a microchannel plate for multiplying the photoelectrons, impressed with a voltage to both ends of the microchannel plate; and a fluorescent screen for converting the photoelectrons multiplied in the microchannel plate to a second optical image, emitting the second optical image to an image pickup device;

a resistance of the microchannel plate being set so that in a case of a luminance of the second optical image being smaller than or equal to saturation sensitivity of the image pickup device, the luminance of the second optical image is proportional to an illuminance of the first optical image, in a case of a luminance of the second optical image being larger than saturation sensitivity of the image pickup device, the luminance of the second optical image is suppressed against increment of the illuminance of the first optical image.

2. An image intensifier apparatus according to claim 1, wherein the microchannel plate is a collection of a plurality of channels, and the resistance per channel is greater than or equal to $2.8\times10^{15}$ Ω and less than or equal to $2.8\times10^{16}$ Ω.

3. An image intensifier apparatus according to claim 1, wherein the microchannel plate has an effective diameter of 18 mm, and the strip resistance is greater than or equal to 1 GΩ and less than or equal to 10 GΩ.

4. An image pickup apparatus comprising:

a photocathode for converting a first optical image to corresponding photoelectrons;

a microchannel plate for multiplying the photoelectrons, impressed with a voltage at both ends of the microchannel plate;

a fluorescent screen for converting the photoelectrons multiplied in the microchannel plate to a second optical image; and an image pickup device for receiving the second optical image, converting the second optical image to charge signal;

a resistance of the microchannel plate being set so that in a case of a luminance of the second optical image being smaller than or equal to saturation sensitivity of the image pickup device, the luminance of the second optical image is proportional to an illuminance of the first optical image, in a case of a luminance of the second optical image being larger than saturation sensitivity of the image pickup device, the luminance of the second optical image is suppressed against increment of the illuminance of the first optical image.

5. An image pickup apparatus according to claim 4, wherein the microchannel plate is collection of a plurality of channels, and the resistance per channel is greater than or equal to $2.8\times10^{15}$ Ω and less than or equal to $2.8\times10^{16}$ Ω.

6. An image pickup apparatus according to claim 4, wherein the microchannel plate has an effective diameter of 18 mm, and the strip resistance is greater than or equal to 1 GΩ and less than or equal to 10 GΩ.

7. An image pickup apparatus according to claim 4, wherein the image pickup device is a charge coupled device.

8. An image pickup apparatus according to claim 4, wherein the image pickup device is coupled on a side of an output of the fluorescent screen using an optical fiber.

* * * * *